United States Patent [19]

DeVos et al.

[11] 4,269,414

[45] May 26, 1981

[54] SLIDE-PUZZLE

[76] Inventors: Marc F. DeVos, Binnenhof 3, Knokke-Heist, Belgium; Hoan G. Gouw, Porto Buenolaan 16, Ouderkerk a/d Amstel, Netherlands

[21] Appl. No.: 82,141

[22] Filed: Oct. 5, 1979

Related U.S. Application Data

[60] Continuation of Ser. No. 895,779, Apr. 12, 1979, abandoned, which is a division of Ser. No. 716,878, Aug. 23, 1976, Pat. No. 4,097,049.

[51] Int. Cl.[3] ..... A63F 9/08

[52] U.S. Cl. ..... 273/153 S

[58] Field of Search ..... 273/153 S; 35/75

[56] References Cited

U.S. PATENT DOCUMENTS

| | | | |
|---|---|---|---|
| 1,101,567 | 6/1914 | Ridgway | 273/153 S |
| 1,206,054 | 11/1916 | Trull | 273/153 S |
| 1,459,937 | 6/1923 | Teipel | 273/153 S |
| 1,477,371 | 12/1923 | Larabee | 273/153 S |

FOREIGN PATENT DOCUMENTS

| | | | |
|---|---|---|---|
| 765605 | 3/1934 | France | 273/153 S |
| 245004 | 12/1925 | United Kingdom | 273/153 S |

*Primary Examiner*—Anton O. Oechsle

*Attorney, Agent, or Firm*—Leydig, Voit, Osann, Mayer & Holt, Ltd.

[57] ABSTRACT

A slide puzzle having a number of flat slide-pieces which are slidably retained in a space formed in a plate by means of interengaging grooves and flanges. The upper surfaces of the plate and slide-pieces fall into the same plane and the space in the plate is dimensioned such that at least one portion of the space corresponding to one slide-piece always remains open. The space in the plate may be formed by an I-shaped opening, a circular recess with a short dead end portion linked to it or a rectangular recessed portion.

1 Claim, 5 Drawing Figures

SLIDE-PUZZLE

This is a continuation of application Ser. No. 895,779 filed Apr. 12, 1978, abandoned which is a divisional of application Ser. No. 716,878, filed Aug. 23, 1976 now U.S. Pat. No. 4,097,049.

The invention relates to a slide-puzzle consisting of a number of substantially flat slide-pieces, said pieces being slidably retained in a space, formed in a plate by means of interengaging grooves and flanges, so that at least the upper surfaces of the slide-pieces and the upper surface of the plate fall into the same plane and the space in the plate has such dimensions with respect to the number of slide-pieces, that always at least one portion of the space corresponding to one slide-piece remains open.

A known slide-puzzle of this kind is the cipher-puzzle, in which the slide-pieces are arranged in rows within a rectangular frame and each is provided with a cipher. Herewith the slide-pieces are provided with interengaging grooves and flanges, which make said known slide-puzzle not suitable for other embodiments.

Object of the invention is to achieve a slide-puzzle having many possibilities for variation.

Said object is achieved in that in the slide-puzzle according to the invention each slide-piece is provided with a circumferential groove and that an inwardly directed projecting flange extends along at least the outer circumference of the space so that each slide-piece at least at two opposite sides embraces a flange with its circumferential groove.

In this way many variations are possible for the slide-puzzle according to the invention.

Thus the space in the plate may be formed by an I-shaped opening the leg of the I and each transverse portion of it being adapted to accommodate three or a larger odd number of slide-pieces being positioned in side by side abutting relationship in a row and that in the middle of the leg an opening is formed in communication therewith and capable to accommodate one slide-piece, whilst the total number of slide-pieces is two times three or two times any larger odd number. Preferably the slide-pieces are provided at both sides with a part of a picture and at both sides of the plate upon the surface portions of the plate adjacent to the transverse portions of the opening, parts of two pictures are provided such, that when the one half of the slide-pieces are positioned in side by side abutting relationship in the correct sequence in the one transverse portion and the other half of the slidepieces are positioned in side by side abutting relationship in the correct sequence in the other transverse portion two complete pictures are shown, whilst at the other side of the plate no coherent pictures are shown.

In a second embodiment of the invention the space is formed by a circular recess in the plate to which a rather short portion links up, said portion coming to a dead end, the inner circumference of said recess also being provided with a projecting flange, whilst three substantially oval-shaped slide-pieces are present, which pieces with their circumferential groove embrace the inner and outer projecting flanges, the circumferential groove of one of said slide-pieces extending inwardly a little bit deeper and at a location approximately opposite the position where the short portion coming to a dead end is in communication with the circular path an obstacle is formed at the inner and/or outer flange by means of which only the one slide-piece with the deeper extending groove may pass said abutment.

In this way a slide-puzzle is obtained with which for instance a shunting problem should be solved, in which case two of the slide-pieces each represent a carriage and the third slide-piece represents a locomotive, with which the carriages which cannot pass the abutment should be conveyed from the one side of the path to the other side.

The space may also be formed by a rectangular recessed portion in the plate and a recessed portion in communication with said rectangular portion, which portion is adapted to accommodate only one slide-piece, in which rectangular portion a number of rectangular guide-plates are disposed, said guide-plates being arranged in vertical and horizontal rows according to a rectangular pattern, said rows being equally spaced apart, while said guide-plates are each connected with the bottom of the recessed portion by means of a connecting stub so that said plates are positioned at the same level as the circumferential flange and said plates form projecting flanges allowing that between said plates and the circumferential flange of the rectangular recessed portion a slide-piece may slide in horizontal as well as in vertical direction, so many slide-pieces being present that the entire rectangular recessed portion is taken up by said slide-pieces in abutting relationship. Preferably on each slide-piece a part of a picture is provided so that said slide-pieces in a certain sequence within the rectangular recessed portion show the complete picture.

The invention will be further elucidated by means of the attached drawings.

Figure 1:
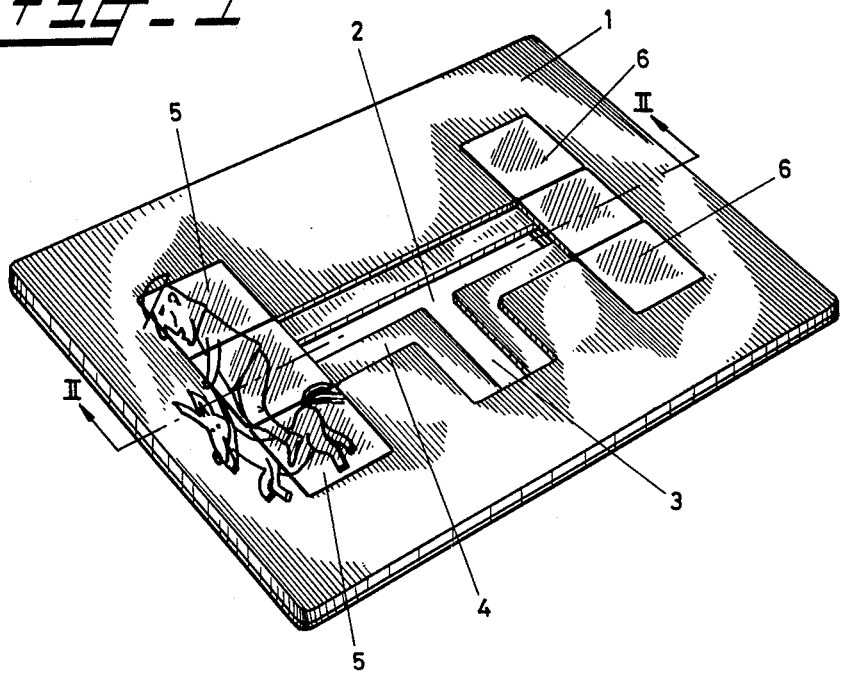
FIG. 1 shows a first embodiment in perspective view according to the invention.
Figure 2:
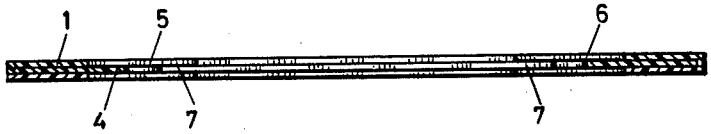
FIG. 2 shows a cross-section according to the line II—II in FIG. 1.

As shown in FIG. 1 the slide-puzzle comprises a plate 1 in which an I-shaped opening 2 with a contiguous opening 3 capable to take up only one slide-piece is provided. Along the outer circumference of the I-shaped opening 2 and the contiguous opening 3 a flange 4 is formed. In each transverse portion of the I three slide-pieces 5 and 6 respectively are positioned. Each slide-piece 5, 6 has a circumferential groove 7 embracing the flange 4. As shown in FIG. 1 for the slide-pieces 5, said pieces arranged in the correct sequence show a picture in the one transverse portion of the I of which picture a part is shown upon the contiguous surface of the plate 1. In the same way the slide-pieces 6 form a picture at the other transverse portion of the I. However, if the plate 1 is turned around then the other sides of the slide-pieces 5 and 6 do not form a coherent picture but the pieces 5 and 6 have to be slid to and fro via the leg of the I and the opening 3 until two coherent pictures are shown at this side of the plate 1. Then, however, the pictures at the side of the plate 1 shown in FIG. 1 are broken so that the pieces 5 and 6 have to be shifted again into the correct positions as shown in FIG. 1.

Figure 3:
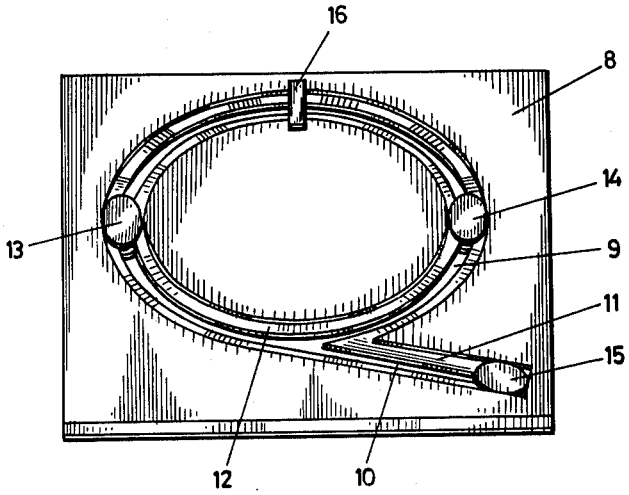
FIG. 3 shows a second embodiment in perspective view according to the invention.

In the embodiment shown in FIG. 3 the space in the plate 8 is formed by a circular opening 9 with a contiguous rather short piece 10, which is coming to a dead end. Along the outer circumference of the openings 9 and 10 extends a flange 11 and along the inner circumference a flange 12 whilst three slide-pieces 13, 14 and 15 are present. Each slide-piece 13, 14 and 15 is provided with a circumferential groove embracing the flanges 11 and 12, however, the circumferential groove of slide-piece 15 extending inwardly a bit deeper than the grooves of the slide-pieces 13 and 14. At 16 an obstacle in the flange 11 and/or 12 is formed so that only the slide-piece 15 with the deeper extending circumferential groove may pass and the slide-pieces 13 and 14 may not pass said obstacle at 16.

Suitably the obstacle is positioned underneath a member 16, arranged in the form of a tunnel, whilst the slide-pieces 13 and 14 are provided with the picture of a carriage and the slide-piece 15 with the picture of a locomotive. The object of said slide-puzzle is to make the carriages 13 and 14 change places by means of the locomotive, in which operation the locomotive 15 should pull or push one or both carriages 13 and 14 and the locomotive 15 should return to its starting position in the shunt 10.

Figure 4:
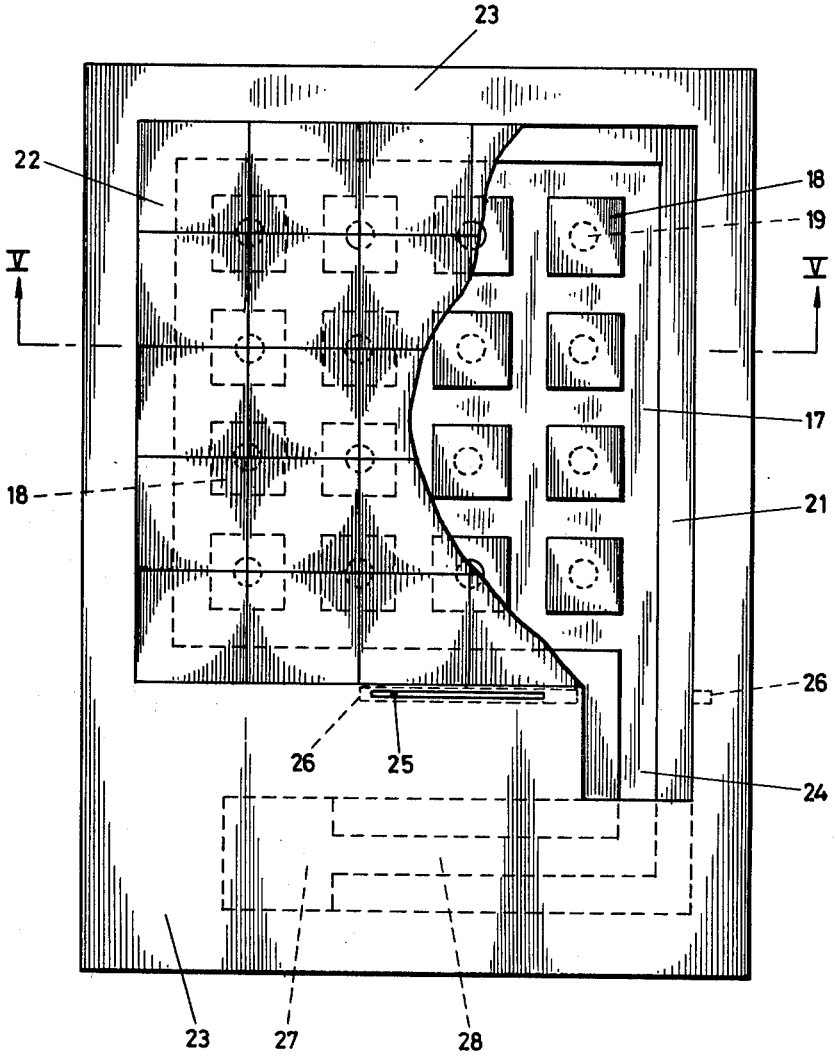
FIG. 4 shows a plan view of a third embodiment according to the invention partly broken away and FIG. 5 shows a cross-section according to the line V—V in FIG. 4.
Figure 5:
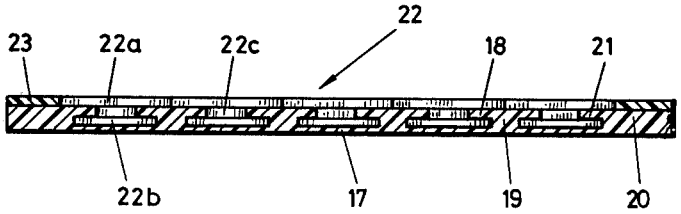

The embodiment shown in the FIGS. 4 and 5 comprises as essential parts a rectangular plate 17, a number of rectangular guide-plates 18, said plates being connected with the base-plate 17 by means of the connection stumps 19, a number of edge-strips 20 forming the circumferential flange 21 and a plurality of slide-pieces 22. The guide-plates 18 are arranged in rows according to a rectangular pattern. The slide-pieces 22 consist of a rectangular upper plate member **22*a*, a rectangular bottom plate member 22*b* and a connection stub 22*c* between the upper and bottom plate members, so that a circumferential groove is formed which embraces with some clearance the guide-plates 18 or the circumferential flange 21**.

Upon the upper plate member **22*a* of each slide-piece 22 a part of a picture is provided (not shown in the figure). The pictures of the several slide-pieces 22** may together form a rectangular picture if the slide-pieces are shifted into the correct mutual positions.

Upon the edges of the assembly a separate covering frame 23 is mounted the height of which corresponding to that of the upper plate members **22*a* of the slide-pieces 22, so that the puzzle has substantially a flat upper surface. In the lower edge-strip 20 and the covering frame 23 a take up compartment 24 provided with flanges 21 is left open. Said take up compartment 24 can be locked eventually by a slide 25 which may be shifted in a groove 26 left open in the plate 17**.

Underneath the lower part of the covering frame 23 an opening 27 is recessed in the material of the strip 20, said opening being in connection with the compartment 24 by means of a channel 28 provided with flanges 21. The opening 27 and the channel 28 serve for inserting the slide-pieces after which the covering frame 23 may be mounted to prevent withdrawal of the slide-pieces.

What is claimed is:

1. A slide-puzzle comprising, in combination, a plate having a substantially rectangular space therein and a rectangular take-up portion in communication with said space, and a plurality of slide-pieces having circumferential grooves therein, the number of slide-pieces being such as to occupy the entire space when the puzzle is solved, said plate forming inwardly directed flanges extending along the inner surface of the part of the plate which forms the perimeter of said space and said take-up portion, said take-up portion being in communication with a channel formed in said plate and provided with inwardly directed flanges, said channel terminating in an opening formed in said plate and dimensioned to receive said slide-pieces therein, said space having a plurality of guide plates arranged in vertical and horizontal rows in order to guide the slide-pieces as they are rearranged to solve the puzzle, said slide-pieces being slidably retained in said space by means of said circumferential grooves interengaging said flanges and guide plates, a frame mounted on the top surface of said plate outboard of said flanges which extend along the perimeter of said space and said take-up portion, said slide-pieces being dimensioned so that the surface thereof lies in the same plane as the surface of the frame, and said frame covering said channel and said opening and blocking the end of said take-up portion so that only one of said slide-pieces may be accommodated in said take-up portion while solving the puzzle and preventing withdrawal of the slide-pieces.

* * * * *